United States Patent [19]

Ettel

[11] 4,022,102

[45] May 10, 1977

[54] METHOD AND APPARATUS FOR ADJUSTING A FUZE AFTER FIRING A PROJECTILE FROM A WEAPON

[75] Inventor: Godwin Ettel, Zurich, Switzerland

[73] Assignee: Werkzeugmaschinenfabrik Oerlikon-Buhrle AG, Zurich, Switzerland

[22] Filed: Feb. 23, 1976

[21] Appl. No.: 660,791

[30] Foreign Application Priority Data

Mar. 10, 1975 Switzerland ..... 2978/75

[52] U.S. Cl. ..... 89/6.5; 89/1 R

[51] Int. Cl.[2] ..... F42C 17/00

[58] Field of Search ..... 89/6.5, 6, 1 R; 102/70.2 R

[56] References Cited

UNITED STATES PATENTS

| | | | |
|---|---|---|---|
| 1,739,921 | 12/1929 | Schuler et al. | 89/6.5 X |
| 1,917,814 | 7/1933 | Rühlemann | 89/6.5 X |
| 2,555,384 | 6/1951 | Watt | 89/6.5 X |
| 3,209,350 | 9/1965 | Davis et al. | 343/6.5 SS |

FOREIGN PATENTS OR APPLICATIONS

| | | | |
|---|---|---|---|
| 2,316,976 | 10/1974 | Germany | 89/6.5 |

*Primary Examiner*—David H. Brown
*Attorney, Agent, or Firm*—Werner W. Kleeman

[57] ABSTRACT

A method of, and apparatus for, adjusting a projectile fuze after firing the projectile out of a weapon, wherein information is transmitted inductively from a transmitter mounted at the weapon to a receiver located in the projectile fuze. The passage of the projectile through a first element triggers the transmission of pertinent information and after such passage the information is computed and stored. Upon passage of the projectile through a second element the information is transmitted in the form of pulses to the receiver and the frequency of the pulses is coordinated to the time available during passage of the projectile so that all information can be transmitted within this time.

8 Claims, 12 Drawing Figures

TIME-DELAY CIRCUIT
54
55
56
DIODE
58
57
SWITCHING TRANSISTOR

RECEIVING COIL
7
AMPLIFIER
24
25
REGISTER
RECEIVER
OSCILLATOR
26
COUNTER
59
63
61
FIRING SWITCH
64
FLIP-FLOP CIRCUIT
60
65
62

INVERTER
68
OSCILLATOR CIRCUIT
77
73
75
76
74
78
79
80
81
82
69
70
71
72
INVERTERS
INVERTERS
M
66
67

TRIGGER COILS
83
84
a
85
COMPUTER
86
STORAGE
87
COMPUTER
88
LARGE COMPUTER INSTALLATION
RECEIVER
89
TRANSMITTER
3
INSDUCTION COIL

METHOD AND APPARATUS FOR ADJUSTING A FUZE AFTER FIRING A PROJECTILE FROM A WEAPON

BACKGROUND OF THE INVENTION

The present invention relates to a new and improved method of adjusting a projectile fuze after firing of a projectile from a weapon wherein the information or data is inductively transmitted from a transmitter secured to the weapon to a receiver located in the fuze. Further, this invention pertains to apparatus for the performance of the aforesaid method.

There is known to the art an arrangement for programming an electrical circuit of a projectile fuze by means of a control coil provided at the muzzle or mouth of a weapon barrel, which during throughpassage of the projectile determines with the aid of a receiver circuit of the projectile the time until detonation or ignition of the projectile fuze. With this prior art arrangement the control coil has a current flowing therethrough, the current intensity of which constitutes a measure for the reference value which is to be set, and the receiver circuit contains a receiver coil and means for evaluating the amplitude of the induced current in the receiver coil which is generated during passage of the projectile through the control coil.

Such arrangement is much too inaccurate for modern day requirements. The amplitude of the induced voltage in the receiver coil during passage through the control coil is first of all dependent upon whether the projectile is moving exactly through the center of the control coil, and secondly, whether the projectile is being propelled through the control coil with the desired starting or initial velocity.

In the event that the time for triggering the detonation or ignition of the projectile fuze must fall within given permissible tolerances, then it can happen that such tolerances cannot be maintained with the heretofore known arrangement.

Furthermore, there is known to the art a fuze actuation device embodying a transmitter installation with a rated frequency-pulse transmitter and a rated frequency-detector arranged in the projectile, the input of which is coupled with a receiving antenna provided at the projectile and the output of which is coupled with the input of a reference value-counter. The output of the counter is coupled with the ignition current circuit so that the fuze fires following a set number of pulses delivered by the transmitter installation.

This fuze actuation device is only suitable for large caliber projectiles, since with small caliber projectiles there is not present sufficient space for either a receiving antenna or the required relatively large energy source.

SUMMARY OF THE INVENTION

Hence, it is a primary object of the present invention to provide an improved method of, and apparatus for, adjusting a fuze after firing of a projectile in a manner not associated with the aforementioned drawbacks and limitations of the prior art proposals.

Another and more specific object of the present invention aims at the provision of a method and apparatus wherein it is possible to maintain, with the requisite accuracy, the time until detonation or ignition of the fuze and also having applicability for small caliber projectiles.

Yet a further object of this invention aims at a novel method of, and apparatus for, controlling the fuze of a projectile such that it positively ignites at a desired point in time.

Now in order to implement these and still further objects of the invention, which will become more readily apparent as the description proceeds, the novel method of this development is manifested by the features that the passage of the projectile through a first element initiates the transmission of the required information or data, and after such passage the information is first calculated and stored. Upon passage of the projectile through a second element the information is transmitted in the form of pulses to the receiver, and the frequency of the pulses is adapted or tuned to the time available during passage so that all information can be transmitted within such time.

Not only is the invention concerned with the aforementioned aspects, but also pertains to apparatus for the performance thereof and such is manifested by the features that there is provided a transmitter possessing a trigger coil forming the first element and arranged at the barrel muzzle or mouth of the weapon. Further, a computer which, for instance, calculates the required information corresponding to the trajectory or flight path of the projectile to the target to be hit, stores such in a register for further transmission to the fuze. The transmitter possesses an induction coil forming the second element and such induction coil is arranged in front of the trigger coil at the barrel muzzle of the weapon and transmits the information stored in the register inductively to a receiver arranged in the fuze. The receiver is equipped with a number of amplifiers.

Tests have shown that with an induction coil of approximately 10 to 12 centimeters length and with a firing speed of approximately 1200 meters per second and with amplifiers it is possible to inductively transmit approximately 8 to 10 pulses from the transmitter coil to the receiver coil. With 8 pulses it is possible with the aid of a digital binary counter to store $2^8 = 256$ bits or numbers, and an equal amount of time can be selected until detonation of the fuze. The remaining pulses are then available for other possible data.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
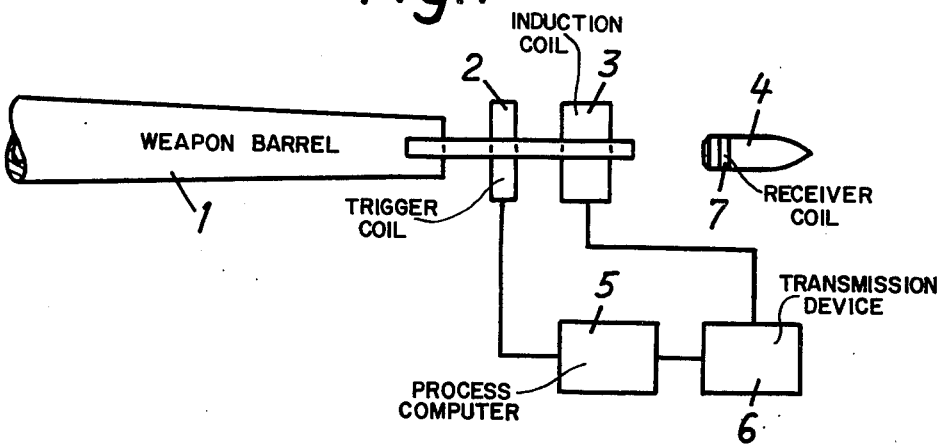
FIG. 1 is a schematic illustration partially portraying apparatus of the invention arranged at the barrel muzzle or mouth of a weapon.

Referring now to the drawings, according to the showing of FIG. 1 there is secured at a weapon barrel 1 of a not further illustrated weapon a trigger coil or winding 2 and an induction coil or winding 3 in such a manner that upon firing of a projectile 4 the latter first penetrates through the trigger coil 2 and thereafter the induction coil 3. Both of these coils 2 and 3 are components of a transmitter which is schematically constituted by a process computer 5 and a transmission device 6. The trigger coil 2 is connected in circuit with the process computer 5 and during passage of the projectile 4 transmits thereto the signal to calculate the requisite or necessary information and to deliver such to the transmission device 6 with which there is connected the induction coil 3 which transmits the information to the fuze located in the projectile. In order to receive the pulses induced by the induction coil 3 a receiver coil 7 is arranged at the projectile 4. As already mentioned heretofore the induction coil 3 is dimensioned such that it is in a position to transmit, during the through-passage of the projectile, 8 to 10 pulses to the receiver coil 7. The spacing between the trigger coil 2 and the induction coil 3 must be selected such that in the time from passage of the projectile 4 through the trigger coil 2 until passage of the projectile 4 through the induction coil 3 the process computer 5 is in a position to calculate the pertinent information or data and to transmit such to the transmission device 6. One of the important functions of the process computer 5 is to calculate on the basis of the initial or starting velocity of the projectile 4 —which can vary from projectile to projectile— the time until initiating detonation of the fuze. Further, there must be taken into account the distance to the target to be hit by the projectile from the weapon, and this can be carried out in conventional manner, for instance with the aid of a laser distance measuring device. Such type device has been disclosed, for instance, in U.S. Pat. No. 3,714,898, granted Feb. 6, 1973 to Richard T. Ziemba, the disclosure of which is incorporated herein by reference. The distance of the target from the weapon is introduced into the process computer 5.

Figure 2:
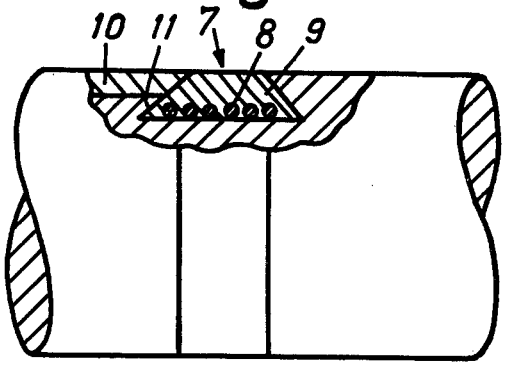
FIG. 2 illustrates part of a projectile.

According to the showing of FIG. 2 the receiver coil 7 possesses a number of wire windings or coils 8 which are embedded in any suitable casting mass 9. In order to insure for the requisite strength against the prevailing centrifugal forces in the case of spinning projectiles, it is necessary to support the coil 7 in a dovetail-shaped groove 11 or equivalent structure. Since the projectile moves during firing through the weapon barrel, and since both the projectile as well as the weapon barrel consist of ferromagnetic material, it is necessary to employ suitable measures to avoid that spurious information or data will be present in the receiver coil 7 due to the weapon barrel magnetism. One such measure can be realized by arranging a magnetic resistance 10. In order to be able to unmistakably transmit two different signals e.g. binary signals 0 and 1 (see FIG. 3) from the induction coil 3 to the receiver coil 7, the induction coil 3 is magnetized in one direction for the binary signal 0 and in the other direction for the binary signal 1 in that the current selectively flows in the one or the other direction through the coil 3. Consequently, the coil 3 can be completely magnetized both for the signal 0 as well as also for the signal 1, whereas the coil 3 is not magnetized between the signals. The pulse interval or interpause between the individual pulses preferably amounts to ten times the pulse duration.

To insure that in the available time during passage of the projectile through the induction coil 3 there can be transmitted at least ten pulses there is necessary a transmission frequency of 100 KHz, assuming that the induction coil is 12 centimeters wide and the projectile velocity is 1200 meters per second.

Figure 4:
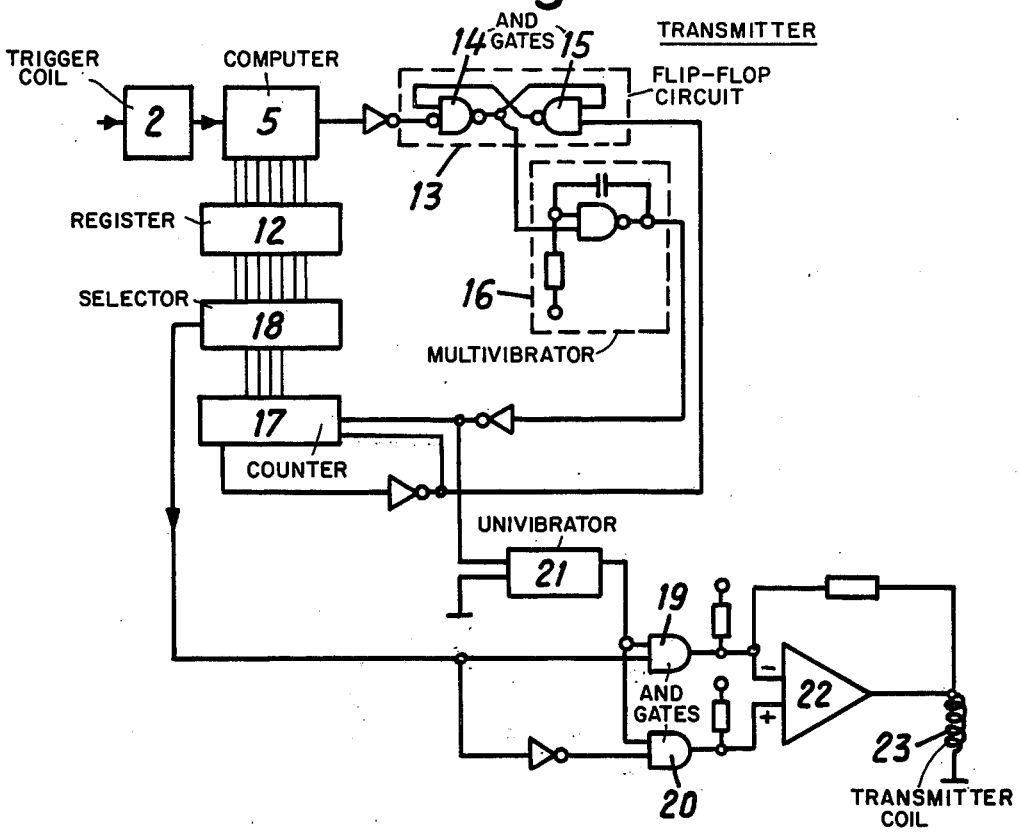
FIG. 4 is a block circuit diagram of the entire transmitter installation.

The construction of the entire transmitter installation has been shown in block circuit diagram in FIG. 4. On the one hand, there is connected to the process computer 5 the trigger coil 2 and on the other hand a register 12 and finally a flip-flop circuit 13 which is formed by two AND-gates 14 and 15. The process computer 5 receives the information from the trigger coil 2 that the projectile 4 is located in the trigger coil 2 and it is thus in a position to calculate when there occurs the passage of the projectile through the induction coil 3. It can therefore deliver a signal to the flip-flop circuit 13 which initiates the transmission of the standard information stored in the register 12 by the process computer 5. Connected with the flip-flop circuit 13 is a multivibrator 16 which in conventional manner can deliver pulses at a uniform time interval to a counter 17. This multivibrator is placed into operation by the flip-flop circuit 13. Between the register 12 and the counter 17 there is arranged a selector 18. This selector 18 selects the data or numbers contained in the register 12 as a function of the numbers or data formed in the counter 17 by the multivibrator 16 and delivers this information to the inputs of two AND-gates 19 and 20. At the inputs of these AND-gates 19 and 20 there is additionally connected a univibrator 21. This univibrator 21, for each data, produces a pulse of a given pulse duration, for instance 1 $\mu$sec (microsecond). The outputs of both AND-gates 19 and 20 are connected to an amplifier 22. This amplifier 22 receives negative signals from one AND-gate 19 and positive signals from the other AND-gate 20. These signals are delivered by the amplifier 22 to a transmitter coil 23 which further delivers the signals to the receiver coil 7 of the projectile 4.

The counter 17 is connected with the flip-flop circuit 13 via a gate, so that after the transmission operation the entire transmitter installation illustrated in FIG. 4 can be reset back into its starting state.

Instead of the register 12 and the selector 18 there can be provided a shift register, the entire transmitter installation then being controlled differently in conventional manner.

Instead of the amplifier 22 there can be arranged two symmetrical switching transistors in known manner.

Figure 5:
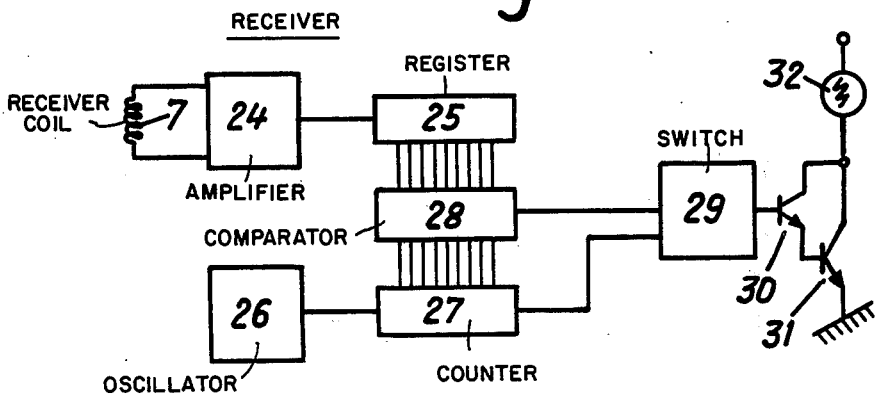
FIG. 5 is a block circuit diagram of the entire receiver installation.

The construction of the entire receiver installation has been illustrated in block circuit diagram in FIG. 5. At the receiver coil 7 there is connected an amplifier 24 and at such a register 25 which records the signals received from the receiver coil 7 and amplifier 24. The receiver installation furthermore possesses an oscillator 26 which at regular time intervals delivers pulses to a counter 27. Between the register 25 and the counter 27 there is arranged a comparator 28 which compares the data or numerical values in the register 25 and the data or numerical values in the counter 27 and upon coincidence delivers a signal to a switch 29 which via transistors 30, 31 triggers a firing element 32. The switch 29 conventionally contains elements for safety purposes i.e. to prevent premature detonation of the projectile at the area of the weapon and is connected directly with the counter 27 for the purpose of self-destruction. This counter 27 is thus capable of initiating the self-destruction or self-detonation upon reaching a certain counter state or number.

Figure 3:
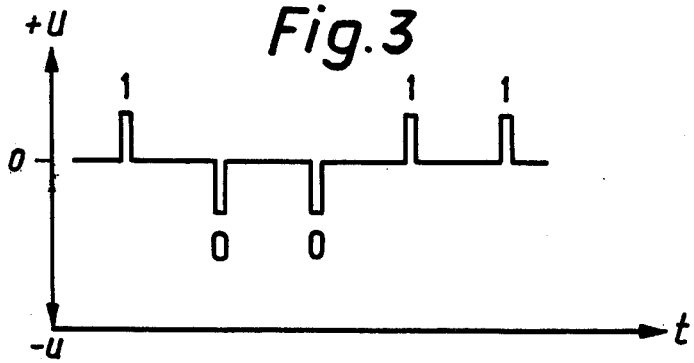
FIG. 3 is a diagram of the transmitted pulses.
Figure 6:
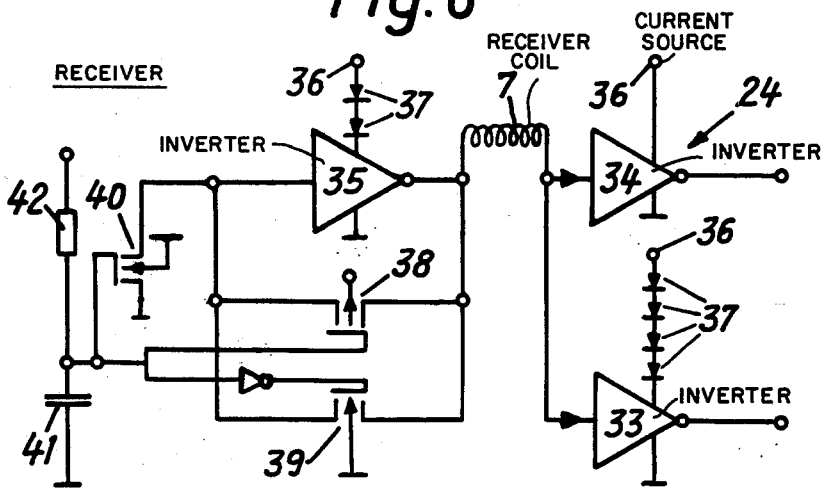
FIG. 6 is a circuit diagram illustrating details of the receiver installation with an amplifier for the received pulses.
Figure 7:
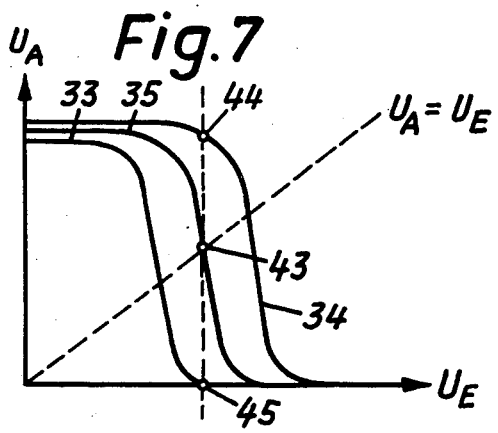
FIG. 7 is a graph showing the voltage course or characteristic of inverters used in the inventive arrangement.

The construction of the amplifier 24 has been illustrated in FIG. 6. The receiver coil 7 is connected on the one hand to the inputs of two inverters 33 and 34 and on the other hand at the output of an inverter 35 as well as via two switching transistors 38 and 39 at the input of this inverter 35. These three inverters 33, 34 and 35 are connected to a common current source 36. The inverter 34 is directly connected to the current source 36, whereas the inverter 33 is connected via four diodes 37 and the inverter 35 via two diodes 37 at the current source 36. Consequently, the inverter 34 receives the entire voltage of the current source whereas the inverters 33 and 35 receive different markedly reduced voltages. At the input of the inverter 35 there are further connected via a third switching transistor 40 a capacitor 41 and a resistor 42, by means of which, upon firing of the projectile, a pulse is transmitted to the switching transistors 38 and 39. As a result, only the inverter 35 is operational when pulses arrive at the receiver coil 7, so that energy can be saved. The outputs of both inverters 33 and 34 are connected to the register 25. The behavior of the three inverters 33, 34 and 35 will be recognized from the graphs of FIG. 7 wherein there is plotted the output voltage $U_A$ as a function of the input voltage $U_E$. Since the three inverters 33, 34 and 35 do not receive the same supply voltage their curves are different, as shown. Since with the inverter 35, with the transistors 38, 39 conductive, the input and output are coupled with one another the output signal is equal to the input signal and is located along the straight line $U_E = U_A$ at the point 43. This signal 43 is delivered via the receiver coil 7 to the inputs of the inverters 33 and 34 and at the inverter 34 furnishes the large output voltage $U_A$ at the point 44 and at the inverter 33 the small output voltage $U_A$ at the point 45, and the signals designated by binary character "1" in FIG. 3 are delivered from one inverter 34 to the register 25 (FIG. 5) and the signals designated by the binary character "0" are delivered from the other inverter 33 to the register 25.

Figure 8:
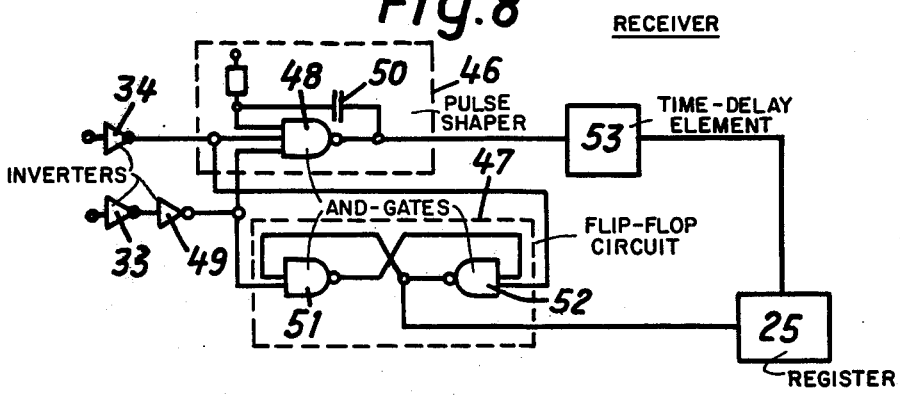
FIG. 8 is a circuit diagram illustrating further details of the receiver installation with a pulse shaper and a flip-flop circuit.

According to FIG. 8 the just described inverters 33 and 34 are connected on the one hand at a pulse shaper 46, and on the other hand at a flip-flop circuit 47. The pulse shaper 46 possesses and AND-gate 48 having three inputs and one output. At the first input of the gate 48 there is connected the inverter 33 through the agency of a further inverter 49. At the second input of the gate 48 there is directly connected the inverter 34, and at the third input of the gate 48 there is connected the output of the gate 48 via a capacitor 50. The flip-flop circuit 47 possesses two AND-gates 51 and 52 each of which possess two respective inputs and one output. As is conventional for flip-flops the output of the one gate 51 is connected at the one input of the gate 52 and the output of the other gate 52 at the other input of the gate 51. At the other input of the gate 51 there is connected the inverter 33 and at the other input of the gate 52 there is connected the inverter 34. The flip-flop circuit 47 is directly connected with the shift register 25 and the pulse shaper 46 is connected via a time-delay element 53 with the shift register 25. The signals of the pulse shaper 46 are all the same, they provide the advance pulses for the shift register, the signals of the flip-flop circuit 47 are positive or negative depending upon whether they emanate from the inverter 33 or from the inverter 34. The register 25 delivers the signals to the comparator 28 illustrated in FIG. 5.

Figures 9, 10, 11, 12:
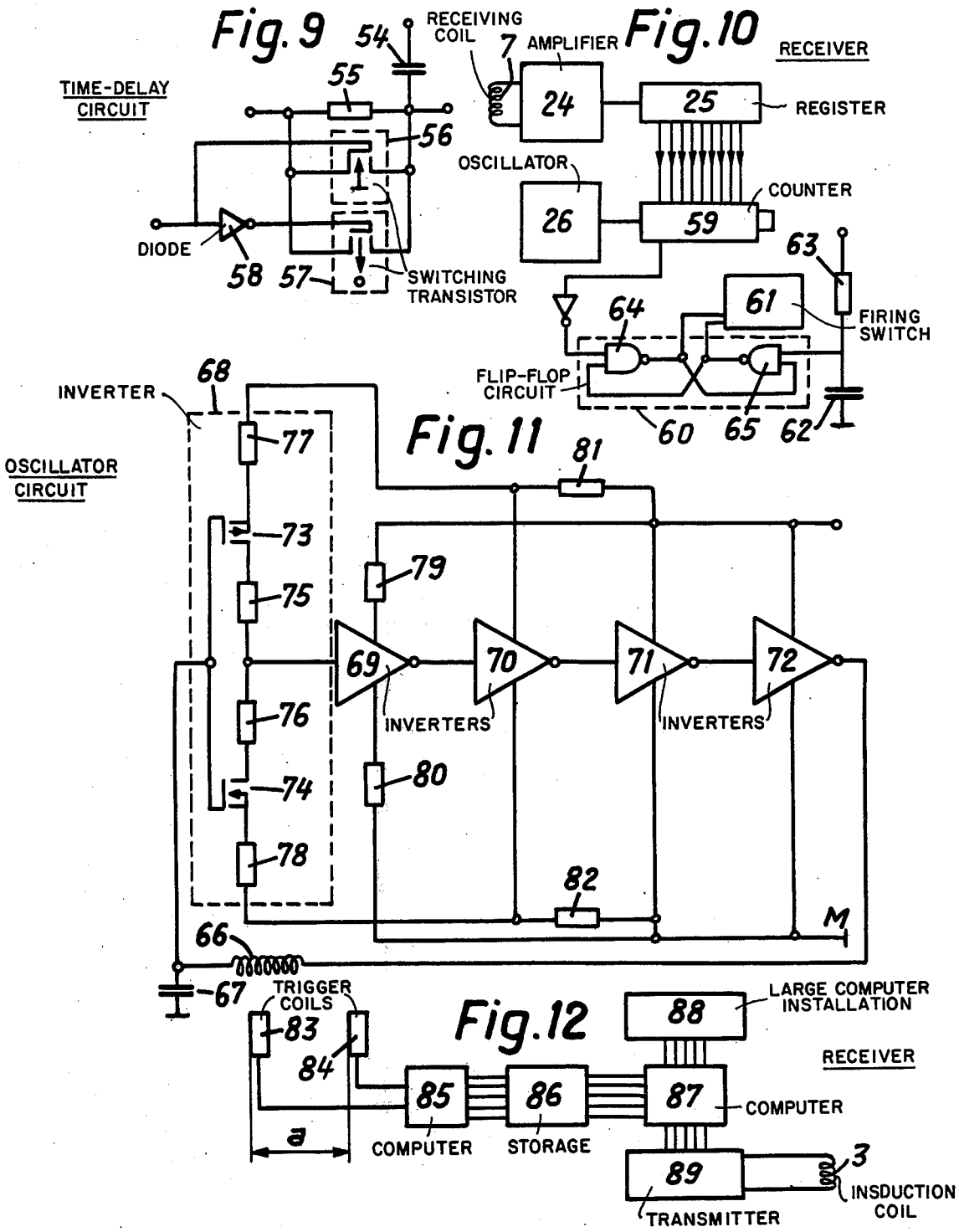
FIG. 9 illustrates apparatus for time-delay firing upon impact of the projectile.
FIG. 10 is a block circuit diagram of a second embodiment of the receiver installation.
FIG. 11 is a circuit diagram of an oscillator used in the invention.
FIG. 12 is a block circuit diagram of a further embodiment of transmitter installation capable of taking into account the starting or initial velocity of the projectile.

According to the showing of FIG. 9 the projectile 7 can possess a device for the delayed ignition upon impact of the projectile at the target.

Such device possesses a capacitor 54 and a resistor 55 which collectively form a time-delay element. The resistor 55 can be disconnected with the aid of two switching transistors 56 and 57, so that the time-delay becomes smaller upon impact of the projectile. The switching transistors 56 and 57 are connected at the register 25 possessing the information for decreasing or enlarging the ignition delay. One of both switching transistors 56 and 57 is connected via a diode 58 at the register 25.

Another exemplary embodiment of the receiver installation has been shown in FIG. 10. With this receiver installation there also can be selected the self-destruction time for that instance when the projectile misses the target and then should be exploded in the air prior to exploding on the ground due to impact. The amplifier 24 in this case is constructed exactly as was the case for the amplifier discussed and illustrated in FIG. 6. Connected with this amplifier 24 is again a register 25 at which there is connected a counter 59 which can be set to a value prescribed by the shift register. This counter 59 is connected with the aforementioned oscillator 26. Counter 59 is connected via a flip-flop circuit 60 at a firing switch 61. The flip-flop circuit 60 is connected at a capacitor 62 and at a resistor 63 which upon firing of the projectile switches the flip-flop circuit 60 due to the firing acceleration with a certain time-delay for the pre-barrel security in order that the counter after reaching a certain counter state corresponding to the self-destruction time can deliver a pulse to the firing switch 61 for triggering self-destruction. The flip-flop circuit 60, analogous to the already described flip-flop circuits 13 and 47, possesses two gates 64 and 65.

The construction of the oscillator illustrated in FIGS. 5 and 10 is apparent from FIG. 11. Suitable for such an oscillator are RC- as well as also LC-oscillating circuits, i.e. oscillating circuits possessing an ohmic resistance and a capacitor as well as also oscillating circuits with an inductive impedance and a capacitor. According to FIG. 11 there is provided a LC-oscillating circuit with an inductive impedance 66 and a capacitor 67. Connected parallel to the inductive impedance 66 are five inverters 68, 69, 70, 71 and 72. The first inverter comprises two switching transistors 73 and 74 which are connected via resistors 75 and 76 at the next inverter 69. Both of the switching transistors 73 and 74 are furthermore connected via resistor 77 with the voltage source 36 and via resistor 78 with ground M. The inverters 69 to 72 are conventional commercially available components. For the purpose of saving on energy the second inverter 69 is connected via a resistor 79 at the voltage source 36 and via a resistor 80 with ground M, and similarly the third inverter 70 is connected via a resistor 81 with the voltage source 36 via a resistor 82 with ground M. The fourth and fifth inverters 71 and 72 are directly connected with the voltage source 36 and with ground M. The output of the fifth inverter 72 is connected with the counter 27 (FIG. 5).

The five inverters 68 to 72 only serve for amplifying the pulses of the oscillating circuit, consisting of the capacitor 67 and an inductive impedance 66. The smaller the switching speed that much greater the current consumption. Since with the first three inverters 68, 69 and 70 the switching speed is still smaller than with the last two inverters 71 and 72, it is necessary to arrange for the first three inverters 68, 69 and 70 the resistors 77, 78 and 79, 80 and 81, 82, respectively. With the last two inverters 71 and 72 such resistors are not necessary since practically no current flows any longer with larger switching speeds.

In the event that the starting velocity $v_o$ of the projectile must be taken into account then there can be used a receiver arrangement of the type shown in FIG. 12.

According to FIG. 12 there are arranged at the muzzle of the not further illustrated weapon barrel two trigger coils 83 and 84 at a predetermined spacing *a* from one another. The projectile 7 which penetrates both of the trigger coils 83 and 84 generates two electrical pulses. From the spacing in time of both of these pulses and from the spatial distance *a* of both coils it is possible to calculate in conventional manner the initial velocity $v_o$. This value is calculated in a so-called $V_o$-computer 85 and delivered to a storage 86. In the storage 86 a correction value is associated with each $V_o$-value which is then delivered to a special purpose computer 87. The special purpose computer 87 is connected with a larger computer installation 88 which, while taking into account the distance to the target, calculates the time until triggering of the detonation or firing of the projectile. This value —augmented by the aforementioned correction value— is further transmitted to the transmitter system 89 which with the aid of the induction coil 3 transmits the information to the projectile.

Finally, it is still here mentioned that the described electrical elements are commercially available on the market, for instance by way of example from Texas Instruments Company under the following designations:

| | | |
|---|---|---|
| (1) Counter 17 (FIG. 4) and 27 (FIG. 5) | SN 7490 | N |
| (2) Counter 59 (FIG. 10) | SN 74161 | N |
| (3) Comparator 28 (FIG. 5) | SN 7485 | N |
| (4) Selector 18 (FIG. 4) | SN 74150 | N |
| (5) Register 12 (FIG. 4) and 25 (FIG. 5) | SN 74100 | N |
| (6) Univibrator 21 (FIG. 4) | SN 74121 | N |
| (7) Multivibrator 16 (FIG. 4) and 26 (FIG. 5) | SN 74132 | N |
| (8) Flip-flop circuit 13 (FIG. 4) and 47 (FIG. 8) as well as 60 (FIG. 10) | SN 7400 | N |
| (9) Pulse Limiter 46 (FIG. 8) | SN 7413 | N |
| (10) Register 25 (FIG. 8) | SN 74164 | N |
| (11) AND-gate | SN 7408 | N |
| (12) Inverter 3314 35 (FIG. 6) | SN 7404 | N |

Regarding the receiver system located in the projectile suitable components produced according to C-MOS technique can be used. The computer 5 (FIG. 4), the amplifier 22 (FIG. 4) as well as the trigger 2 (FIG. 4) are also conventional components.

While there are shown and described present preferred embodiments of the invention, it is to be distinctly understood that the invention is not limited thereto, but may be otherwise variously embodied and practiced within the scope of the following claims.

According, what is claimed is:

1. A method for adjusting a projectile fuze after having been fired out of a weapon barrel, wherein the information is inductively transmitted in the form of pulses from a transmitter secured to the weapon to a receiver located in the projectile fuze, and the frequency of the pulses is tuned to the time available during passage of the projectile at the transmitter, so that all information can be transmitted within this time, the improvement comprising the steps of:

1. passing the projectile through a first element;
2. initiating the transmission of information upon passage of the projectile through the first element;
3. after such passage first calculating the information and storing the same;
4. passing the projectile through a second element; and
5. upon passage of the projectile through the second element transmitting the information in the form of pulses to the receiver.

2. An apparatus for adjusting a projectile fuze after firing of the projectile through a firing weapon barrel, comprising a receiver arranged in the projectile, a transmitter secured to the firing weapon barrel, said transmitter possessing a trigger coil forming a first element, said trigger coil being arranged at a muzzle of the firing weapon barrel, a computer in circuit with said trigger coil for calculating the information, a register in which there is stored the information which is further transmitted to the fuze, the transmitter further including an induction coil forming a second element which is arranged in front of the trigger coil at the muzzle of the firing weapon barrel and which inductively transmits the information stored in the register to said receiver arranged in the projectile.

3. The apparatus as defined in claim 2, wherein the receiver of the projectile comprises a receiver coil having an input and an output, an amplifier connected in circuit with the receiver coil, said amplifier containing three inverters having inputs and outputs, means for connecting the first inverter with a large supply voltage, means for connecting the second inverter with a small supply voltage, said first and second inverters being connected with their respective input at the output of the receiver coil, means for connecting the third inverter at an intermediate supply voltage, said third inverter being connected with its output at the input of the receiver coil.

4. The apparatus as defined in claim 3, further including a pair of switching transistors, the third inverter connected with the intermediate supply voltage being connected with its input via said pair of switching transistors with the input of the receiver coil.

5. The apparatus as defined in claim 2, further including a supply voltage, and the receiver arranged in the projectile comprises an oscillator defining an oscillating circuit containing an inductive impedance and a capacitor, and for amplifying the oscillating circuit comprising the conductive impedance and the capacitor there are provided a number of inverters, individual ones of said inverters being connected via resistors with supply voltage.

6. The apparatus as defined in claim 5, wherein an inverter of said oscillator possesses two switching transistors connected in parallel to one another, said last-mentioned inverter forming a first amplifier stage.

7. The apparatus as defined in claim 2, wherein the trigger coil upon firing of the weapon turns-on the computer, flip-flop circuit means connected with the computer by means of which there is initiated information transmission from the computer, and counter means connected with the flip-flop circuit means which upon reaching a predetermined counter state cuts-off the information transmission.

8. The apparatus as defined in claim 7, wherein the receiver arranged in the projectile incorporates means for turning-on the receiver upon passage of the projectile through the trigger coil.

* * * * *